US007380897B2

(12) United States Patent
Anderson et al.

(10) Patent No.: US 7,380,897 B2
(45) Date of Patent: Jun. 3, 2008

(54) METHOD AND APPARATUS FOR CALIBRATING A PRINTHEAD

(75) Inventors: Timothy L. Anderson, Lexington, KY (US); James L. Bush, III, Lexington, KY (US); Michael D. Donovan, Lexington, KY (US); Nathan W. Foley, Lexington, KY (US); Martin A. Johnson, Winchester, KY (US); Patrick L. Kroger, Versailles, KY (US); Tommy O. Lowe, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 401 days.

(21) Appl. No.: 11/145,801

(22) Filed: Jun. 6, 2005

(65) Prior Publication Data

US 2006/0274107 A1 Dec. 7, 2006

(51) Int. Cl.
*B41J 29/393* (2006.01)
*B41J 29/38* (2006.01)

(52) U.S. Cl. ..... 347/19; 347/14

(58) Field of Classification Search ..... 347/19, 347/14, 10
See application file for complete search history.

(56) References Cited

U.S. PATENT DOCUMENTS

| | | | |
|---|---|---|---|
| 5,448,269 | A | 9/1995 | Beauchamp et al. |
| 5,600,350 | A | 2/1997 | Cobbs et al. |
| 5,796,414 | A | 8/1998 | Sievert et al. |
| 6,164,750 | A | 12/2000 | Subirada et al. |
| 6,196,652 | B1 | 3/2001 | Subirada et al. |
| 6,234,602 | B1 | 5/2001 | Soto et al. |
| 6,334,720 | B1 | 1/2002 | Kato et al. |
| 6,554,390 | B2 | 4/2003 | Arquilevich et al. |
| 6,609,777 | B2 | 8/2003 | Endo |
| 6,629,747 | B1 | 10/2003 | King et al. |
| 6,669,321 | B2 | 12/2003 | Yoshida |
| 6,669,322 | B2 | 12/2003 | Gaston et al. |
| 6,669,324 | B1 | 12/2003 | King et al. |
| 6,685,297 | B2 | 2/2004 | Butterfield et al. |
| 6,761,426 | B2 | 7/2004 | Tsuchiya et al. |

*Primary Examiner*—Shih-Wen Hsieh
(74) *Attorney, Agent, or Firm*—Taylor & Aust, P.C.

(57) ABSTRACT

A method for calibrating a printhead includes printing a test pattern, scanning the test pattern to obtain calibration data, performing an ink drop velocity optimization for the printhead using the calibration data, and determining a bi-directional offset based on the calibration data.

25 Claims, 12 Drawing Sheets

METHOD AND APPARATUS FOR CALIBRATING A PRINTHEAD

BACKGROUND OF THE INVENTION

1. Field of the Invention

The present invention relates to an imaging apparatus, and, more particularly, to an apparatus and method for calibrating a printhead.

2. Description of the Related Art

In ink-jet printer systems, calibrations are required in order to ensure that the ejected drops of ink land at the desired location on the print medium. In one aspect of calibration, it is desirable that the appropriate amount of energy is used in order to eject the ink drops. The use of too little firing energy may result in variations in the amount and location of the ejected ink drops, resulting in unacceptable printed results. Too much firing energy may result in a reduced life of the printhead. The ink drop velocity can vary due to differences in the printhead, for example, different heater chip resistances or piezo electric crystal characteristics, changes in voltage level of power supply, and ink chemistry.

In addition, in order to perform bi-directional printing, e.g., printing while the printhead is moving across the page in a first direction and also printing as it is moving back in the opposite direction, it is necessary to compensate for the different printing directions so that the ink is deposited in the desired location.

What is needed in the art is an apparatus and method for calibrating a printhead.

SUMMARY OF THE INVENTION

The present invention provides an apparatus and method for calibrating a printhead.

The invention, in one exemplary embodiment thereof, relates to a method for calibrating a printhead. The method includes printing a test pattern; scanning the test pattern to obtain calibration data; performing an ink drop velocity optimization for the printhead using the calibration data; and determining a bi-directional offset based on the calibration data.

The invention, in another exemplary embodiment thereof, relates to a method for calibrating a printhead. The method includes printing a single test pattern; and scanning the single test pattern to determine an ink drop velocity optimization for the printhead and alignment data for the printhead.

The invention, in another exemplary embodiment thereof, relates to an imaging apparatus configured for calibrating a printhead of the imaging apparatus. The imaging apparatus includes a printer portion configured to mount the printhead, a scanner portion, and a controller communicatively coupled to the printer portion and the scanner portion. The controller is configured to execute instructions for printing a test pattern; scanning the test pattern to obtain calibration data; performing an ink drop velocity optimization for the printhead using the calibration data; and determining a bi-directional offset based on the calibration data.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
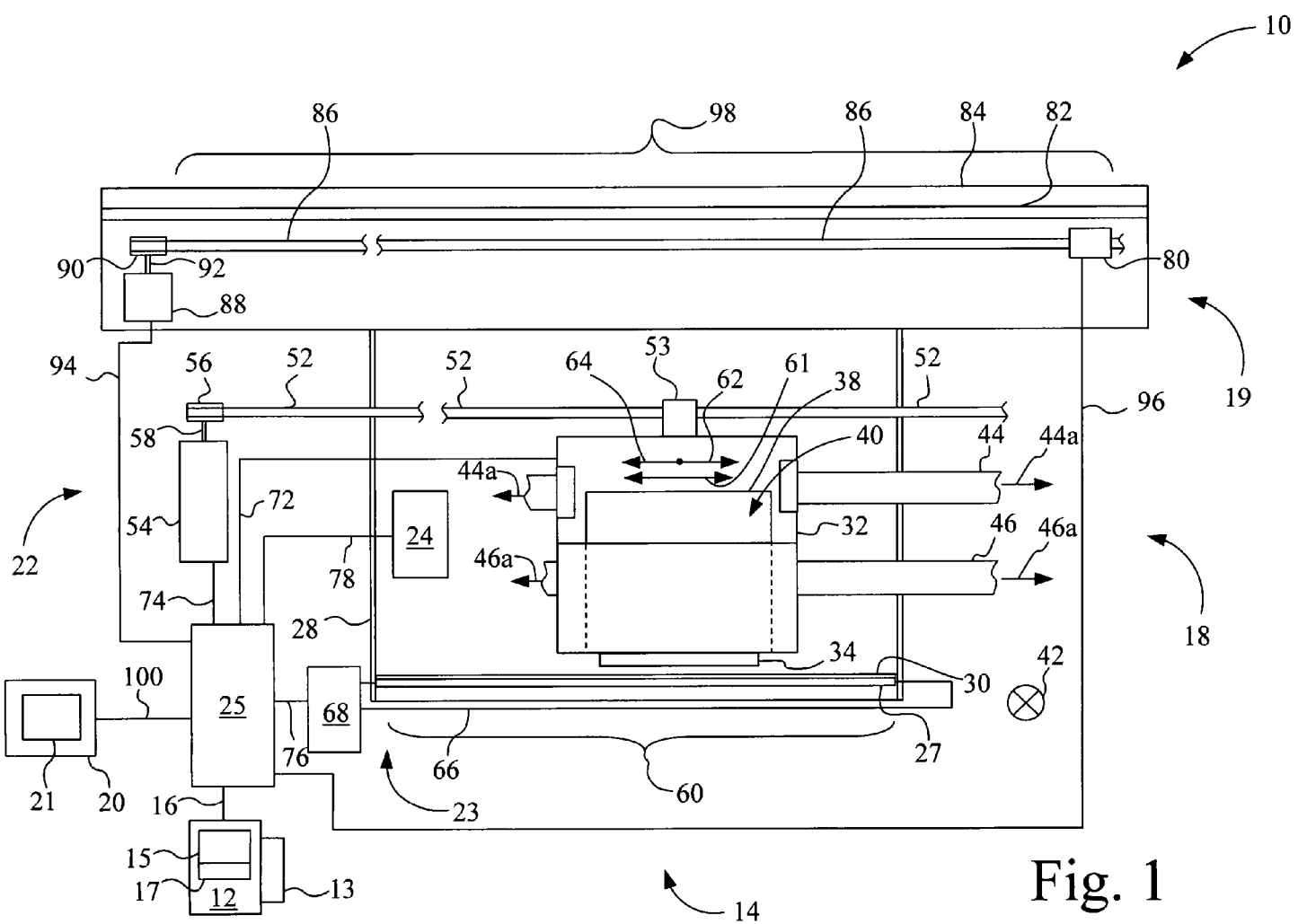
FIG. 1 is a diagrammatic representation of an imaging system embodying the present invention.
Figure 2:
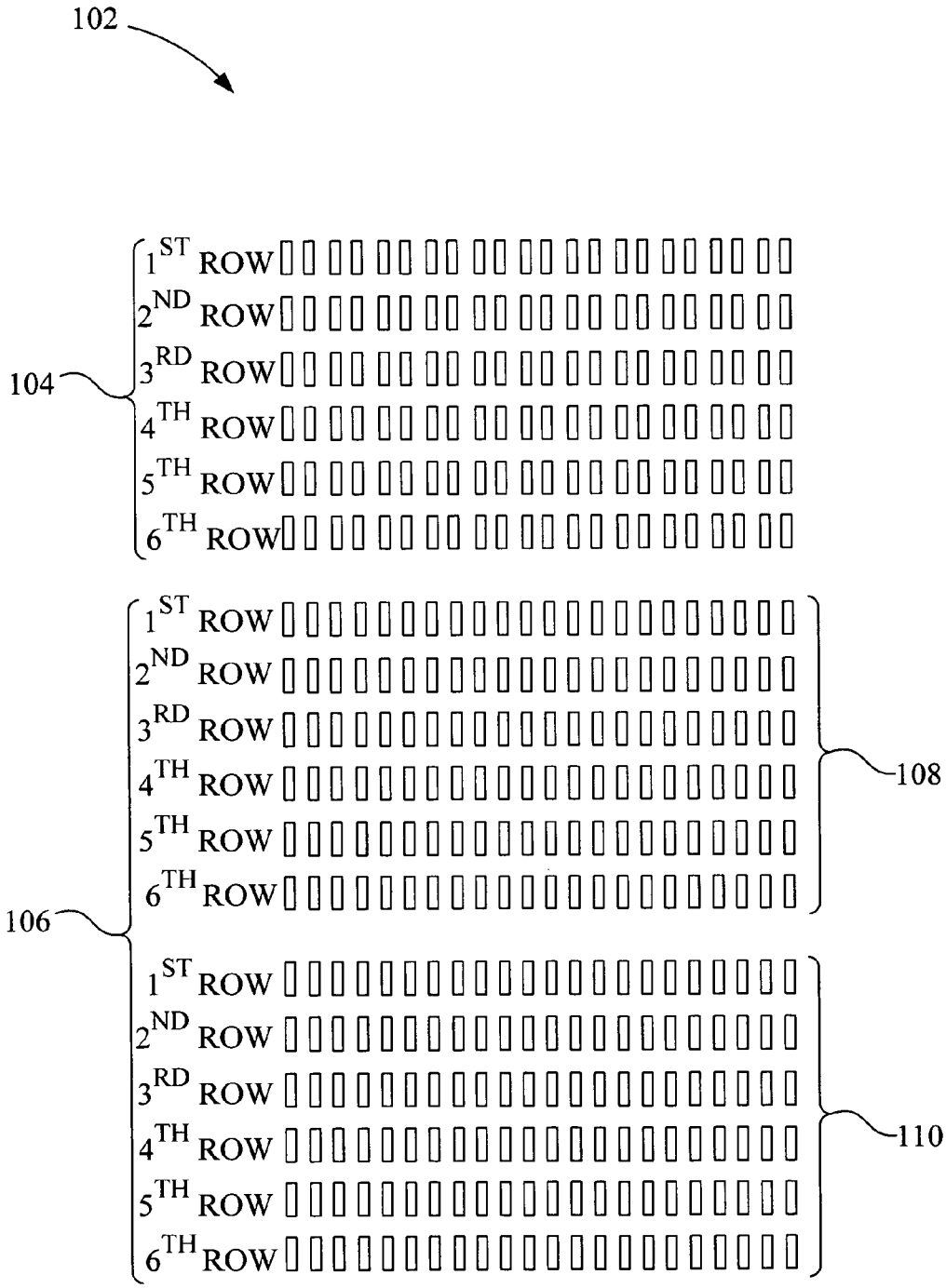
FIG. 2 depicts a test pattern that is printed and measured to determine ink drop velocity optimization and bi-directional offsets in accordance with an embodiment of the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of a multi-function apparatus, such as for example, a standalone unit that has faxing and copying capability, in addition to printing.

Host 12, which may be optional, may be communicatively coupled to imaging apparatus 14 via a communications link 16. Communications link 16 may be, for example, a direct electrical connection, a wireless connection, or a network connection.

In embodiments including host 12, host 12 may be, for example, a personal computer including a display device, such as display monitor 13, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as an imaging driver 15 for imaging apparatus 14. Imaging driver 15 is in communication with imaging apparatus 14 via communications link 16. Imaging driver 15 includes a data formatter 17 that places print data and print commands in a format that can be recognized by imaging apparatus 14, and a halftoning unit. In a network environment, communications between host 12 and imaging apparatus 14 may be facilitated via a standard communication protocol, such as the Network Printer Alliance Protocol (NPAP).

Imaging apparatus 14 includes a printer portion 18, a scanner portion 19, and a user interface 20 with display 21.

As used herein, scanner portion 19 relates to a conventional scanner, e.g., a flat bed scanner, that is adapted for use in performing ink drop velocity optimization and bi-directional alignment in accordance with the present invention.

Printer portion 18 includes a printhead carrier system 22, a feed roller unit 23, a sheet picking unit 24, a controller 25, a mid-frame 27, and a media source 28.

Media source 28 is configured to receive a plurality of print media sheets from which a print medium, e.g., a print media sheet 30, is picked by sheet picking unit 24 and transported to feed roller unit 23, which in turn further transports print media sheet 30 during a printing operation. Print media sheet 30 can be, for example, plain paper, coated paper, photo paper or transparency media.

Printhead carrier system 22 includes a printhead carrier 32 for mounting and carrying printhead 34. An ink reservoir 38 is provided in fluid communication with printhead 34. Those skilled in the art will recognize that printhead 34 and ink reservoir 38 may be formed as individual discrete units, or may be combined as an integral unitary printhead cartridge 40. Although a single printhead 34 is employed in the embodiment described, it will be understood that any combination of one, two, or more printheads of the same or different colors or combinations of colors may be employed without departing from the scope of the present invention. In the present embodiment, printhead 34 employs nozzles for printing two drop sizes, e,g, "big" drops and "small" drops, respectively. It will be appreciated that any number of drop sizes may be employed without departing from the scope of the present invention.

During normal operation, print media is fed into imaging apparatus 14 in a media feed direction 42, also referred to as the y-axis, designated as an X in a circle to indicate that media feed direction 42 is perpendicular to the plane of FIG. 1. In performing printing, printhead 34 is transported in a direction perpendicular to media sheet feed direction 42 as set forth below.

As shown in FIG. 1, printhead carrier 32 is guided by a guide member 44 and a guide rod 46. Each of guide member 44 and guide rod 46 includes a respective horizontal axis 44*a*, 46*a*. The horizontal axis 44*a* of guide rod 46, also sometimes referred to herein as a scan axis 44*a* or X-axis 44*a*, generally defines a bi-directional scanning path for printhead carrier 32. Accordingly, the bi-directional scanning path is associated with printhead 34.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 25, printhead carrier 32 is translated in a reciprocating manner along guide member 44 and guide rod 46. Carrier motor 54 can be, for example, a direct current (DC) motor or a stepper motor.

The reciprocation of printhead carrier 32 transports ink jet printhead 34 across the print media sheet 30 along X-axis 44*a* to define a print zone 60 of imaging apparatus 14. The reciprocation of printhead carrier 32 occurs in a main scan direction 61 (bi-directional) that is parallel with X-axis 44*a*, and is commonly referred to as the horizontal direction. Main scan direction 61 includes a left-to-right carrier scan direction 62 and a right-to-left carrier scan direction 64. Generally, during each scan of printhead carrier 32 while printing, the print media sheet 30 is held stationary by feed roller unit 23.

Mid-frame 27 provides support for print media sheet 30 when print media sheet 30 is in print zone 60, and in part, defines a portion of a print media path of imaging apparatus 14.

Feed roller unit 23 includes a feed roller 66 and corresponding index pinch rollers (not shown). Feed roller 66 is driven by a drive unit 68. The index pinch rollers apply a biasing force to hold print media sheet 30 in contact with respective driven feed roller 66. Drive unit 68 includes a drive source, such as a stepper motor, and an associated drive mechanism, such as a gear train or belt/pulley arrangement. Feed roller unit 23 feeds print media sheet 30 in a direction parallel to media feed direction 42. The media feed direction 42 is commonly referred to as the vertical direction, which is perpendicular to the horizontal bi-directional scanning path, and in turn, perpendicular to the horizontal carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 25 includes a microprocessor having an associated random access memory (RAM) and read only memory (ROM). Controller 25 may be a printer controller, a scanner controller, or may be a combined printer and scanner controller, for example, such as for use in a copier or a multifunction unit. In the present embodiment, controller 25 is a combined printer and scanner controller capable of controlling both printer portion 18 and scanner portion 19 of imaging apparatus 14. Although controller 25 is depicted as residing in imaging apparatus 14, alternatively, it is contemplated that all or a portion of controller 25 may reside in host 12, for example, as part of imaging driver 15. Nonetheless, as used herein, controller 25 is considered a part of imaging apparatus 14.

Controller 25 executes program instructions to effect the printing of an image on print media sheet 30, such as for example, by selecting the index feed distance of print media sheet 30 along the print media path as conveyed by feed roller 66, controlling the reciprocation of printhead carrier 32, and controlling the operations of printhead 34.

Controller 25 also executes instructions to effect the scanning of an item by scanner portion 19, for example, a document or an image, and extracts image data pertaining to the scanned item that may be used to reproduce a likeness of the item using, for example, display monitor 13 and/or printer portion 18.

Controller 25 is electrically connected and communicatively coupled to printer portion 18 including printhead 34 via a communications link 72, such as for example a printhead interface cable. Controller 25 is electrically connected and communicatively coupled to carrier motor 54 via a communications link 74, such as for example an interface cable. Controller 25 is electrically connected and communicatively coupled to drive unit 68 via a communications link 76, such as for example an interface cable. Controller 25 is electrically connected and communicatively coupled to sheet picking unit 24 via a communications link 78, such as for example an interface cable.

Printhead 34 may include at least two sizes of nozzles, for example, large nozzles and small nozzles, or alternatively may include nozzles all of which being of substantially the same size. In the present embodiment, printhead 34 includes both large and small nozzles.

Scanner portion 19 of imaging apparatus 14 includes a scan bar 80, a scan-bed 82 and a cover 84.

Scanner portion 19 and printer portion 18 are each configured for operation independent of the other, such that scanner portion 19 may perform scanning while printhead carrier system 22 and printhead 34 remain stationary in printer portion 18.

Scan bar 80 is connected to a scan bar transport belt 86 that is driven by a scanner motor 88 via a scanner pulley 90. Scanner motor 88 has a rotating scanner motor shaft 92 that is attached to scanner pulley 90. Scanner motor 88 can be, for example, a direct current (DC) motor or a stepper motor, and is controlled by controller 25, which is electrically connected and communicatively coupled to scanner portion 19 via a communications link 94, such as for example an interface cable.

At the directive of controller 25, scan bar 80 is translated in a reciprocating manner along scan-bed 82 to obtain image data from a document or image that rests on scan-bed 82. Image data obtained by scan bar 80 is fed into controller 25, which is electrically connected to and communicatively coupled to scan bar 80 via a communications link 96, such as for example an interface cable. Cover 84 retains the document or image in place during scanning operations. The reciprocation of scan bar 80 across scan-bed 82 defines a scanning zone 98 of scanner portion 19 of imaging apparatus 14.

User interface 20 and display 21 are connected to controller 25 via a communications link 100, such as for example an interface cable. User interface 20 and display 21 are used, for example, to receive user input and commands, and to provide status, printing or scanning options, instructions, and/or other information to the user of imaging apparatus 14 for use in operating printer portion 18 and scanner portion 19 of imaging apparatus 14.

In order for imaging apparatus 14 to provide optimal print output, an ink drop velocity optimization (VO) must be performed for printhead 34, and a bi-directional alignment must also be performed for printhead 34.

The velocity optimization pertains to selecting the appropriate firing energy that is used to eject ink from the nozzles of printhead 34. Although in the present embodiment printhead 34 is a thermal printhead that employs conventional ink jet ink, those skilled in the art would appreciate that the present invention is equally applicable for use in conjunction with a piezo-electric printhead or other printhead-type that causes ink or other colorants to be placed upon print media sheet 30, without departing from the scope of the present invention.

The bi-directional alignment of printhead 34 pertains to adjusting the effective timing at which the ink is to be ejected from the nozzles such that the ejected ink drops will land in designated locations on print media sheet 30 without regard to the direction of transport of printhead 34, e.g., left-to-right carrier scan direction 62 or right-to-left carrier scan direction 64, and compensates for a time-of-flight delay between when an ink nozzle is fired and when the ink drop lands on print media sheet 30.

The entry segment of the imaging apparatus market it is driven by the need for low cost methods for providing user functions. One of these functions is the alignment of the cartridges and the calibration of the fire pulse to optimize for energy usage. This has been accomplished in the past by the use of an "auto alignment sensor." In contrast, and in accordance with an embodiment of the present invention, a scanback alignment allows for providing velocity optimization and bi-directional alignment without the necessity of an auto alignment sensor, by using the conventional scanner included with imaging apparatus 14, e.g., scanner portion 19.

For example, the flat-bed scanner in a scanner/printer/copier type system, such as scanner portion 19 of imaging apparatus 14, can be used to perform auto-alignment. This reduces the cost of the imaging apparatus, since a separate sensor on the printhead carrier may be eliminated. In such a case, one option would be to require the user to print the page and then place it on the flat-bed scanner. However, requiring a user to (1) print the velocity optimization page, (2) place the page in the scanner and determine the correct VO, (3) print an additional, alignment page with the new VO value, and then (4) place the AA page on the scan-bed for its measurement, places an undesirable burden on the user, and the process can be somewhat lengthy.

Referring now to FIGS. 2 and 3A-3C, a method for calibrating a printhead in accordance with an embodiment of the present invention is depicted in the form of a flowchart with respect to steps S200-S234.

The present invention, as described herein with respect to an embodiment, includes printing a single test pattern 102 and scanning single test pattern 102 to determine an ink drop velocity optimization for printhead 34 and alignment data for printhead 34. The alignment data includes bi-directional offsets for printhead 34. Single test pattern 102 is printed in a single printing operation on a print medium, such as print media sheet 30, using imaging apparatus 14, without removing the print medium from printer portion 18 of imaging apparatus 14 prior to completion of printing of single test pattern 102. The scanning of single test pattern 102 in accordance with the present invention is not performed until single test pattern 102 is completely printed, and the scanning is performed as a single scanning operation of the entirety of single test pattern 102.

In the present embodiment, the single test pattern 102 (hereinafter, test pattern 102), includes more than one sub-pattern as described below. For example, test pattern 102 includes a velocity optimization (VO) sub-pattern 104 and a bi-directional (BIDI) alignment sub-pattern 106. Only a single printing operation is performed in order to completely print test pattern 102. That is, the entire test pattern 102 is printed continuously from start to finish, without, for example, printing a portion of test pattern 102, making measurements, and then printing another portion of test pattern 102. The ink drop velocity optimization is determined based on the first sub-pattern, e.g., VO sub-pattern 104. Although the present embodiment is described with respect to sub-patterns of test pattern 102, those skilled in the art would appreciate that the use of a test pattern without any sub-patterns is well within the scope of the present invention.

The bi-directional offset associated with the present invention includes a first offset and a second offset, wherein the first offset pertains to a first print mode, e.g., a draft print mode, and wherein the second offset pertains to a second print mode, e.g., a normal print mode. In accordance with the present embodiment, at least one of the first offset and the second offset are determined based on the second sub-pattern, e.g., BIDI alignment sub-pattern 106, and the other offset is determined based on the first sub-pattern, e.g., VO sub-pattern 104. Alternatively, however, it is contemplated that both of the first offset and the second offset may be determined based on the second sub-pattern, e.g., BIDI alignment sub-pattern 106.

In describing the present embodiment, it should be considered that controller 25 is configured to execute instructions to perform each operation of the embodiment disclosed below herein unless otherwise specified, such as, for example, the placing of print media sheet 30 on scan-bed 82, which is performed by the user, e.g., operator of imaging apparatus 14.

Figure 3A:
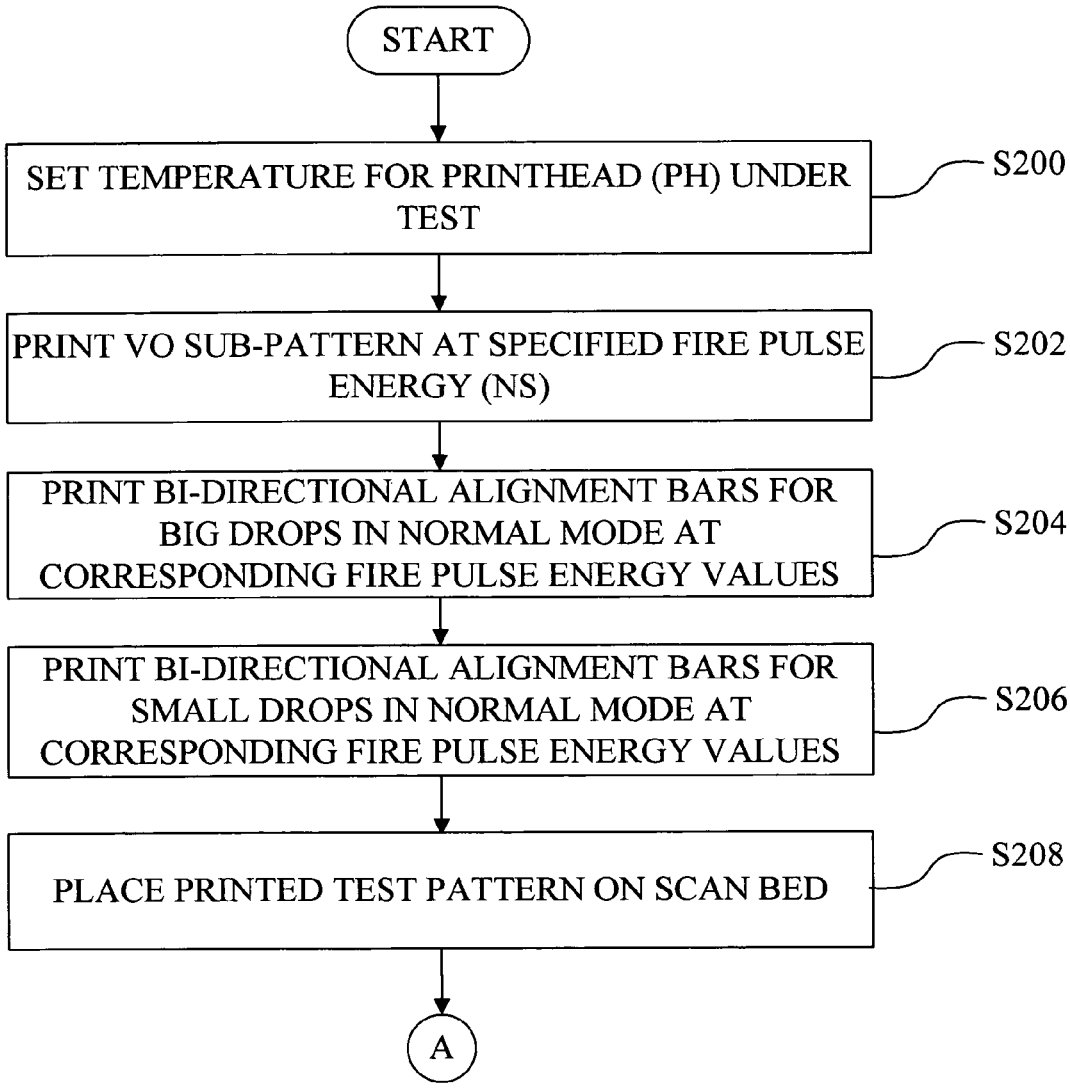
FIGS. 3A-3C are a flowchart depicting an embodiment of a method of calibrating a printhead in accordance with the present invention.

Referring now to FIG. 3A, at step S200, printhead 34 is stabilized at a desired operating temperature, e.g., 55° C.

At step S202, VO sub-pattern 104 is printed at specified fire pulse energies, for example, firing pulses having pulse widths ranging from 950 nanoseconds to 500 nanoseconds. In the present embodiment, the VO sub-pattern consists of 6 rows of sets of two adjacent vertical bars, wherein the first row is printed at the maximum firing energy, e.g., 950 nanoseconds, and each following row, e.g., from top to bottom, is printed using a progressively lower firing energy, with the last row being printed at a firing energy of 500 nanoseconds. Thus, in the present embodiment, the first (top) row is printed at 950 nanoseconds, the second row at 860 nanoseconds, the third row at 770 nanoseconds, the fourth row at 680 nanoseconds, the fifth row 590 nanoseconds, and the sixth (bottom) row at 500 nanoseconds.

For each set of two adjacent vertical bars in VO sub-pattern 104, one bar is printed with printhead 34 traveling in left-to-right carrier scan direction 62, and the adjacent bar is printed in with printhead 34 traveling in right-to-left carrier scan direction 64. Thus, the bars are organized alternatingly such that for each side-by-side pair of bars in any given row, one bar is printed with printhead 34 traveling in left-to-right carrier scan direction 62, and the other bar is printed with printhead 34 traveling in right-to-left carrier scan direction 64.

VO sub-pattern 104 is printed in a draft quality print mode, e.g., 40 inches per second (ips) printhead carrier 32 scanning speed. Alternatively, however, VO sub-pattern 104 may be printed in normal print mode or any other desirable print mode without departing from the scope of the present invention.

Typically, when printing bi-directional alignment patterns, a right-start adjustment value (a.k.a. right-start adjust, X_adj), is employed to adjust the position at which ink is first ejected while printhead 34 is moving in right-to-left carrier scan direction 64, whereas the print start position used for printing in left-to-right carrier scan direction 62 is held as a constant. In printing VO sub-pattern 104 with the present embodiment, the right-start adjust value is not employed, and thus the output of printhead 34 is considered to be raw.

Alternatively, however, it is contemplated that the right-start adjust value is employed, and ink drop velocity calculations are adjusted to compensate accordingly, as set forth below in step S214.

Figure 4:
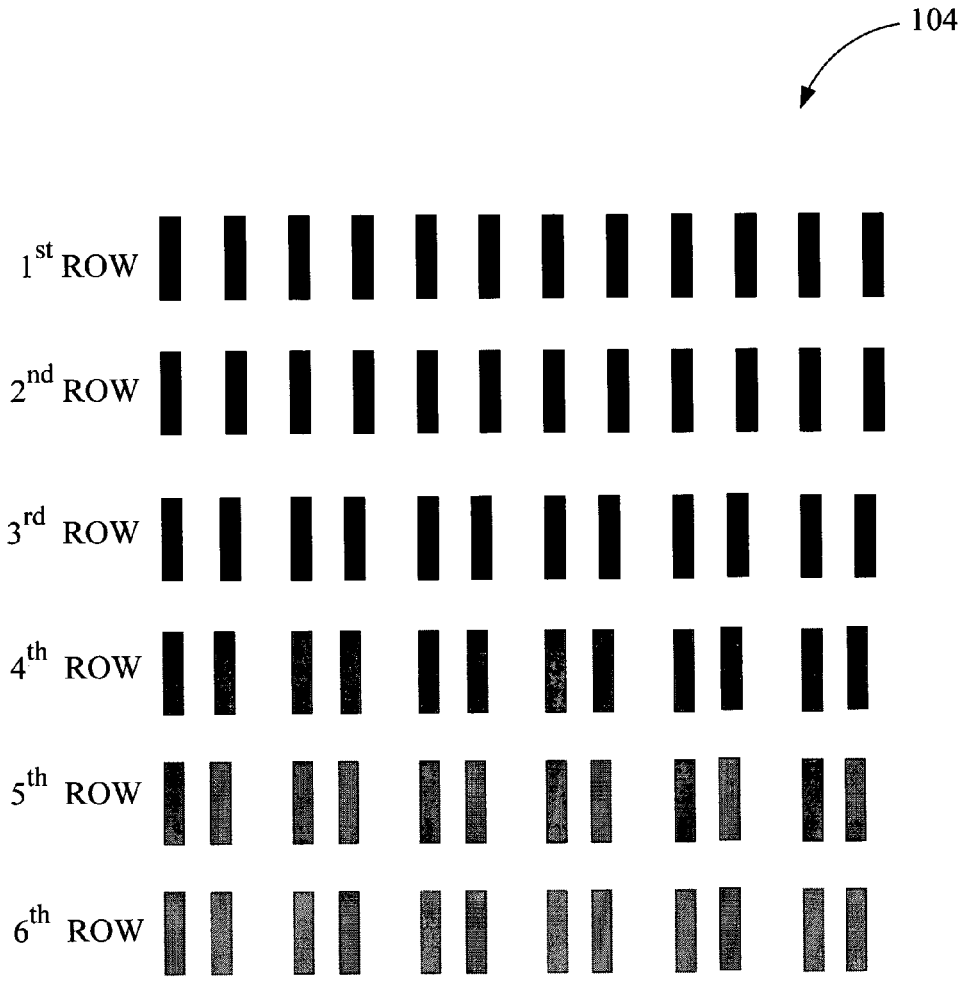
FIG. 4 depicts a velocity optimization sub-pattern in accordance with an aspect of the present invention.

Referring now to FIG. 4, a close-up view of VO sub-pattern 104 is depicted. It is observed that the spacing between bars in each pair is greater in the first row, and progressively decreases towards the sixth row. This is because the higher fire pulse energies in the upper rows result in a higher ink drop velocity, and hence, the time-of-flight delay (e.g., the time between when the ink drop is ejected from printhead 34 and when it reaches print media sheet 30) associated with higher firing pulse energies is less than the time-of-flight delay associated with the decreased firing energies. Similarly, the top rows appear darker than the bottom rows due to the fact that the amount of ink ejected by printhead 34 increases generally with the amount of firing energy.

At step S204 BIDI alignment bars 108 for the printhead 34 nozzles that print the big drop size are printed as part of BIDI alignment sub-pattern 106 of test pattern 102. BIDI alignment bars 108 are printed using only the nozzles of printhead 34 that eject the big drop size, and not those nozzles that eject the small drop size. BIDI alignment bars 108 are printed using a "normal" print mode (30 inch per second printhead carrier 32 speed), in contrast to the bars of VO sub-pattern 104, which were printed in draft print mode. The "normal" print mode is that print mode that provides the standard level of printing performance and quality of imaging apparatus 14, as opposed to draft print mode, which produces printed output more quickly, but at a slight sacrifice of print quality.

As with VO sub-pattern 104, one half of BIDI alignment bars 108 are printed with printhead 34 traveling in left-to-right carrier scan direction 62, and the other half of BIDI alignment bars 108 are printed with printhead 34 traveling in right-to-left carrier scan direction 64. The bars are organized alternatingly such that for each side-by-side pair of bars in any given row one bar is printed with printhead 34 traveling in left-to-right carrier scan direction 62, and the other bar is printed with printhead 34 traveling in right-to-left carrier scan direction 64.

BIDI alignment bars 108 are organized in 6 rows with firing energies that correspond to the firing energies used to print the six rows of VO sub-pattern 104. For example, the top row (first row) of BIDI alignment bars 108 is printed at a firing energy that corresponds to the firing energy used to print the top row (first row) of VO sub-pattern 104, e.g., 950 nanoseconds. Similarly, the firing energies used to print the second through sixth rows of BIDI alignment bars 108 correspond with the firing energies used to print the second through sixth rows of VO sub-pattern 104.

At step S206, BIDI alignment bars 110 for the printhead 34 nozzles that print the small drop size are printed as part of BIDI alignment sub-pattern 106 of test pattern 102. BIDI alignment bars 110 are printed using only the nozzles of printhead 34 that eject the small drop size, and not those nozzles that eject the large drop size. As with BIDI alignment bars 108, BIDI alignment bars 110 are printed using the normal print mode, and hence, in the present embodiment, BIDI alignment sub-pattern 106 is printed using the normal print mode. BIDI alignment bars 110 are printed and organized in the same manner as described above with respect to step S204 and BIDI alignment bars 108.

At step S208, the user places print media sheet 30 containing the printed test pattern 102 on scan-bed 82 of scanner portion 19, and closes cover 84.

Figure 3B:
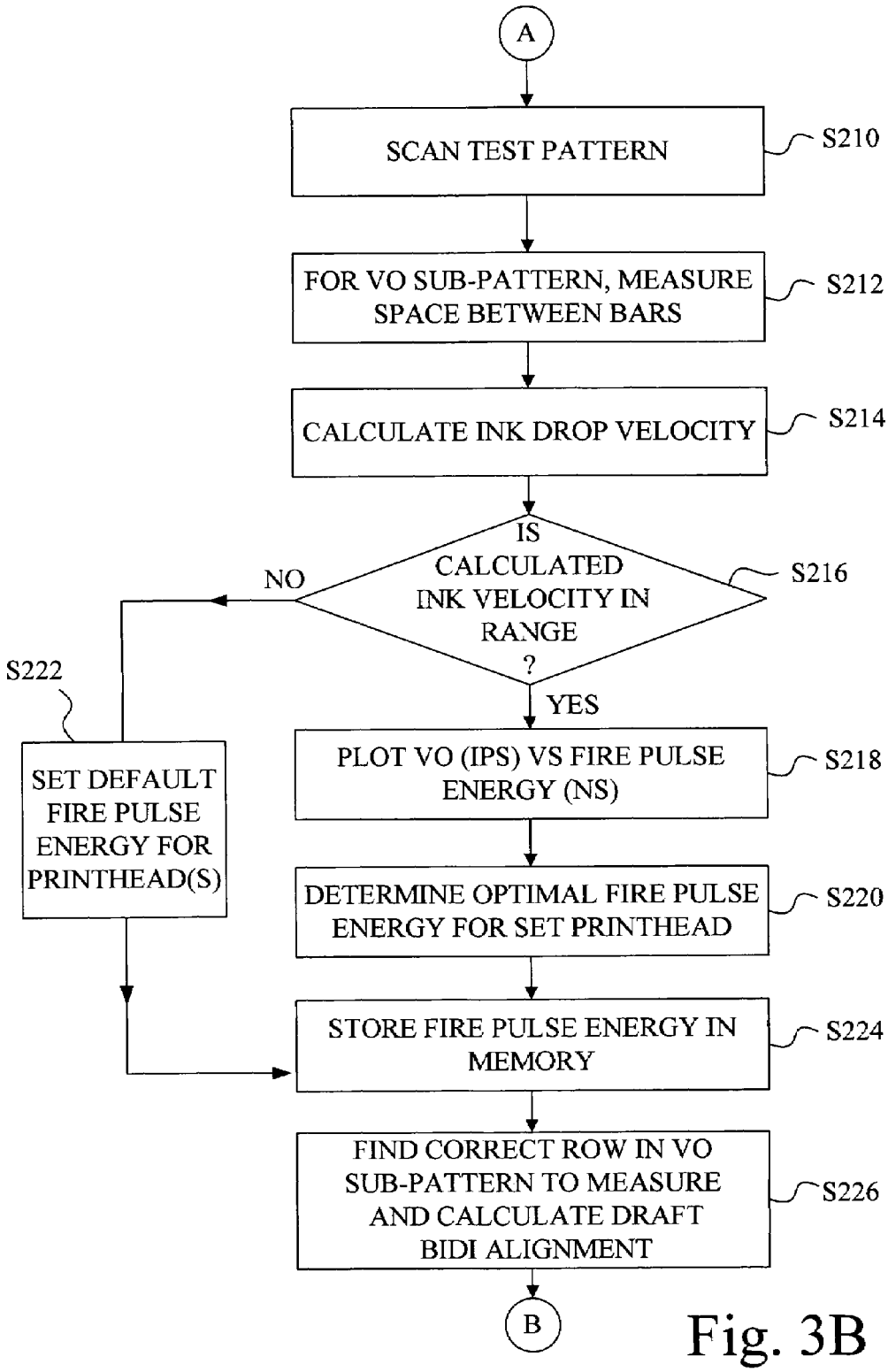

Referring now to FIG. 3B, controller 25 executes instructions to scan test pattern 102 to obtain calibration data and to perform and store in memory an ink drop velocity optimization for printhead 34 using the calibration data, as set forth in steps S210-S224. During the scanning of test pattern 102, printer portion 18, including printhead 34, may remain stationary, as they are independent of scanner portion 19.

At step S210, the entirety of test pattern 102 is scanned using scanner portion 19 of imaging apparatus 14 in a single scanning operation to obtain calibration data. The calibration data is based on measuring the distance between vertical bars of test pattern 102.

At step S212, the spaces between the vertical bars of VO sub-pattern 104 are measured, for example, the distances between the middles of each adjacent bar, between the leading edges of each adjacent bar, or between trailing edges of each adjacent bar. These measurements are part of the calibration data obtained by the present invention, and are employed by the present invention in performing ink drop velocity optimization and in determining bi-directional offset values for performing bi-directional alignment of printhead 34.

Figure 5:
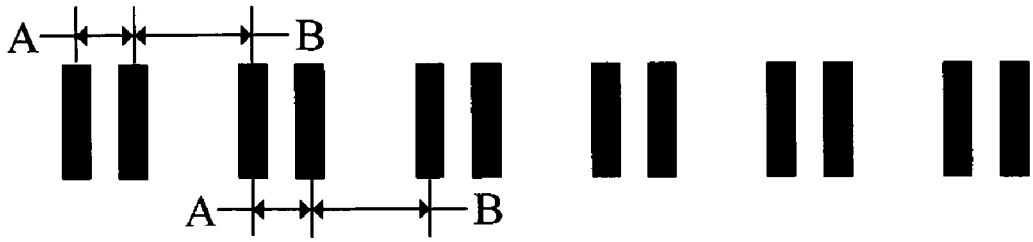
FIG. 5 depicts measurements used in calibrating a printhead in accordance with an aspect of the present invention.

Referring now to FIG. 5, an example of measuring the spaces between bars is depicted.

Measurements "A" and "B" are successively taken for all the groupings of bars in a particular row, and are averaged to determine an average offset between bars of D=(AVG(A)+AVG(B))/2. Since each row of VO sub-pattern 104 is made up of repeated pairs of two bars, the average offset, D, for each row is sufficient to provide a reliable result for that row. The average offset, D, is measured and determined for each row, and since the different rows were printed using different firing energies, the value of D will be different for each row.

Referring again to FIG. 3B, at step S214, the ink drop velocity is calculated for each of the 6 rows of vertical bars of VO sub-pattern 104. The ink drop velocity for each row is then stored in memory along with an identifier for the corresponding row.

For example, the velocity may be calculated as follows:

$$V=2V_cG/D \quad \text{(Equation 1)}$$

where V is the ink drop velocity, $V_c$ is the velocity of printhead carrier 32, and hence, printhead 34, G is the gap between printhead 34 and print media sheet 30 upon which test pattern 102 has been printed, e.g., the vertical distance separating the ink nozzles and print media sheet 30, and D is the offset value determined for the particular row in step S212.

As set forth above in step S202, the right-start adjust value may alternatively be employed when printing VO sub-pattern 104. If so, the calculation of ink drop velocity is modified to accommodate the right-start adjust value, X_adj, as follows:

$$V=2V_cG/(D+X_\text{adj}) \quad \text{(Equation 2)}$$

where V is the ink drop velocity, $V_c$ is the velocity of printhead carrier 32, and hence, printhead 34, G is the gap between printhead 34 and print media sheet 30 upon which test pattern 102 has been printed, D is the offset value determined for the particular row in step S212, and X_adj is a default bi-directional offset value, for example, 44/4800 inch.

At step S216, a determination is made as to whether the calculated ink drop velocities are within a predetermined range, for example, between 500 nanoseconds and 950 nanoseconds. If so, process flow proceeds to step S218. Otherwise, process flow proceeds to step S222, where a default fire pulse energy is set for printhead 34, e.g., 950 nanoseconds.

At step S218, the calculated ink drop velocities (V0), e.g., measured in inches per second (ips) are plotted against fire pulse energy, e.g., as measured in nanoseconds of pulse width. Step S218 does not include generating a physical plot or any plot that may be readily viewed by the user, but rather, relates to calculations performed by controller 25 as part of the determination of the optimum ink drop velocity. However, for purposes of convenience of explanation, a physical plot is presented herein.

Figure 6:
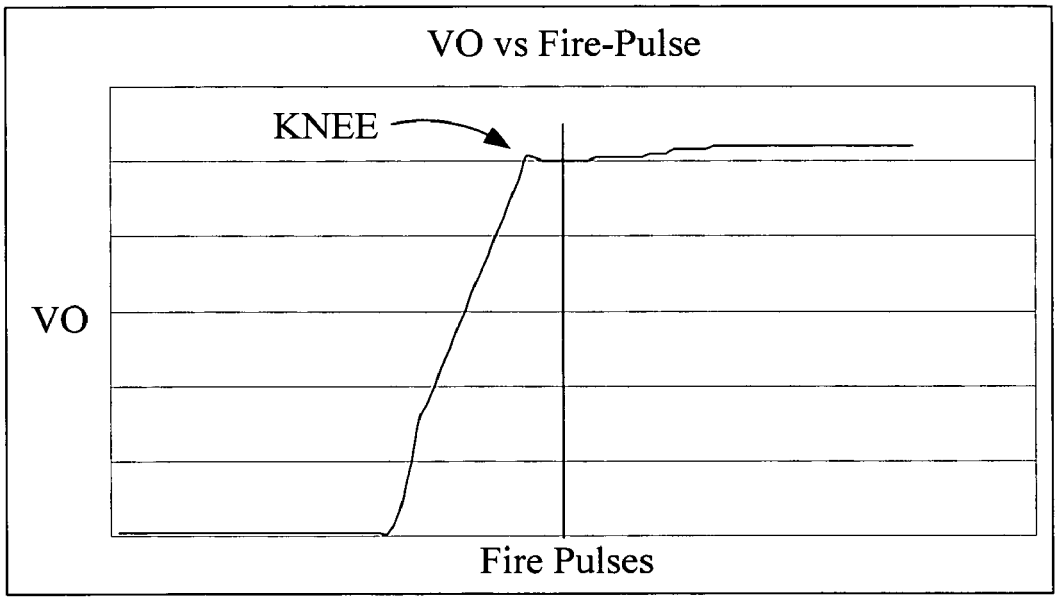
FIG. 6 is a graph depicting a plot of ink drop velocity optimization (VO) with respect to fire pulse energy used in describing an embodiment of the present invention.

Referring now to FIG. 6, a plot of VO versus fire pulse energy is depicted.

Referring again to FIG. 3B in conjunction with FIG. 6, the optimal fire pulse width energy for printhead 34 is determined. The plot of FIG. 6 may be described thusly: Generally, very low fire pulse energies will not result in the expulsion of ink from printhead 34. However, once a nucleation threshold has been reached, ink drops will be ejected. Ink drop velocity after this point increases with increasing fire pulse energy until a "knee" in the VO vs. fire pulse energy curve has been reached. After the "knee," increases in fire pulse energy result in little or no increase in ink drop velocity.

At step S220, the optimal fire pulse energy for the set printhead, e.g., printhead 34, is determined.

The goal of ink drop velocity optimization is to essentially find the "knee" in the curve, and add a margin of safety to this value to compensate for variations in printhead 34 performance. For example, to compensate for variations in printhead 34 mean operating temperature, changes in ink properties, such as to account for changes in ink viscosity with respect to time due to evaporation, and performance degradation of printhead 34, e.g., due to oxidative damage to firing resistors, nozzle wear, etc.

By performing ink drop velocity optimization, suitable printing performance can be had, but without providing too high a fire pulse energy that would otherwise cause unnecessary and potentially disadvantageous and/or damaging heating of printhead 34, as well as being an environmentally unsound waste of electrical energy.

In the present embodiment, the optimal fire pulse energy is determined by finding the "knee" in the VO vs. fire pulse energy curve, inputting this value into a lookup table, and selecting a corresponding output value from the table that includes the aforementioned margin of safety.

At step S224, the fire pulse energy, which is the value determined at steps S216-S222, is stored in a memory of imaging apparatus 14, for example, in controller 25 along with the corresponding row in VO sub-pattern 104, e.g., the first, second, third, fourth, fifth, or sixth row of VO sub-pattern 104. Alternatively, however, it is contemplated that the fire pulse energy and the corresponding row are stored in host 12 or as part of imaging driver 15.

Figure 3C:
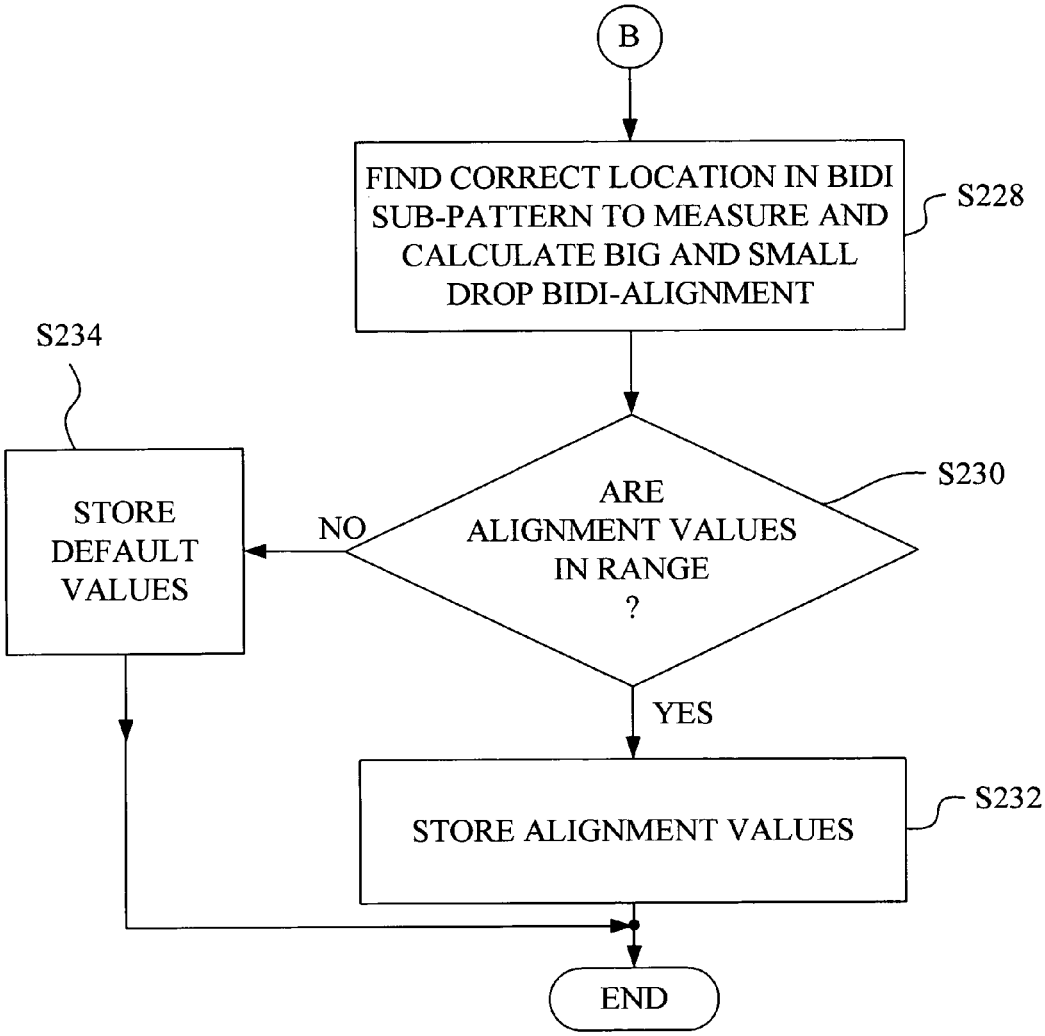

Referring now to FIG. 3C in conjunction with FIG. 3B, controller 25 executes instructions to scan test pattern 102 to determine bi-directional offsets based on the calibration data, as set forth in steps S226-S234, below.

At step S226, the correct row in VO sub-pattern 104 is found and measured to calculate the draft print mode bi-directional offset. In the present embodiment, VO sub-pattern 104 was printed in the draft quality print mode, as set forth above, and hence, the bi-directional offset data obtained in step S226 is used to perform bi-directional alignment for the draft print mode. As set forth below in steps S228-S234, additional measurements are taken as part of the calibration data obtained by the present invention, and are used for determining additional bi-directional offset values that are also used for performing bi-directional alignment of printhead 34.

The "correct" row in VO sub-pattern 104 corresponds to the row printed using the appropriate firing energy once the velocity has been optimized. For example, if the optimal ink drop velocity, and hence fire pulse energy, were found in steps S216-S224 to correspond with the third row in VO sub-pattern 104, the measurement data pertaining to the third row in VO sub-pattern 104 will be used to calculate the draft print mode bi-directional offset. Step S226 does not include a physical "finding" of the appropriate row in VO sub-pattern 104, e.g., using scanner portion 19. Rather, step S226 pertains to electronically selecting the calibration data stored in memory that corresponds to the row associated with the fire pulse energy determined and stored in memory at steps S216-S224, e.g., the optimal or default fire pulse energy.

Referring again to FIG. 5, the calculation of the draft print mode bi-directional offset is described. Note that the results of the calculation pertain to the draft print mode because VO sub-pattern 104 was printed using the draft print mode.

Measurements "A" and "B" are successively taken for all the groupings of bars in a particular row, and are averaged to determine an average bi-directional offset between bars of D=(AVG(A)−AVG(B))/2. Since each row of VO sub-pattern 104 is made up of repeated pairs of two bars, the average offset, D, for the selected row is sufficient to provide a reliable result as a draft print mode bi-directional offset value. In the present example, the third row of VO sub-pattern 104 is used to obtain the draft print mode bi-directional offset value.

Referring now to FIG. 3C, at step S228, the correct rows in BIDI alignment sub-pattern 106 are found. There are two rows found in step S228, one each from BIDI alignment bars 108 and BIDI alignment bars 110. For example, if the optimal ink drop velocity, and hence fire pulse energy, were found in steps S216-S224 to correspond with the third row in VO sub-pattern 104, the measurement data pertaining to the third row in BIDI alignment bars 108 and in BIDI alignment bars 110 will be used to calculate the normal print mode bi-directional offsets for the "big" drop size nozzles of printhead 34 and for the "small" drop nozzles of printhead 34, respectively.

In the present example, measurements of "A" and "B" are successively taken for all the groupings of bars in the third rows of BIDI alignment bars 108 and BIDI alignment bars 110, and are averaged to determine an average bi-directional offset between bars of D=(AVG(A)−AVG(B))/2 for each of the normal print mode bi-directional offsets for the "big" drop size nozzles of printhead 34 and for the "small" drop size nozzles of printhead 34, respectively.

At step S230, it is determined whether the alignment values are within a predefined range, for example, between 0 and $^{80}/_{4800}$ inch. If so, process flow proceeds to step S232, and the bi-directional offsets for draft print mode (one offset value determined at step S226) and normal print mode (two offset values determined at step S228) are stored in a memory of imaging apparatus 14, e.g., in controller 25. Alternatively, however, it is contemplated that the bi-directional offsets are stored in host 12 or as part of imaging driver 15.

If at step S230 it is determined that the bi-directional alignment values are not within the predetermined range, process flow proceeds to step S234, wherein default values for each of the offset values that are not within the predetermined range are stored in memory in place of the corresponding values determined at steps S226 and S228.

Referring now to FIGS. 7A-7C and 8, a method for method for calibrating a printhead in accordance with another embodiment of the present invention is depicted in the form of a flowchart with respect to steps S300-S330.

The present embodiment includes printing a single test pattern 112 and scanning single test pattern 112 to determine an ink drop velocity optimization for printhead 34 and alignment data for printhead 34. The alignment data includes a bi-directional offset for printhead 34, and single test pattern 112 is printed in a single printing operation on a print medium, such as print media sheet 30, using imaging apparatus 14 without removing the print medium from printer portion 18 of imaging apparatus 14 prior to completion of printing of single test pattern 112. The scanning of single test pattern 112 in accordance with the present invention is not performed until single test pattern 112 is completely printed, and the scanning is performed as a single scanning operation of the entirety of single test pattern 112.

In the present embodiment, the single test pattern 112 (hereinafter, test pattern 112), includes more than one sub-pattern. For example, test pattern 112 includes a velocity optimization (VO) sub-pattern 114 and a bi-directional (BIDI) alignment sub-pattern 116. VO sub-pattern 114 is printed using a first print mode, e.g., draft print mode, whereas BIDI alignment sub-pattern 116 is printed using both the first print mode and a second print mode, e.g., normal print mode. Only a single printing operation is performed in order to completely print test pattern 112. That is, the entire test pattern 112 is printed continuously from start to finish, without, for example, printing a portion of test pattern 112, making measurements, and then printing another portion of test pattern 112. The ink drop velocity optimization is determined based on the first sub-pattern, e.g., VO sub-pattern 114.

The bi-directional offset associated with the present invention includes a first offset and a second offset, wherein the first offset pertains to a first print mode, e.g., draft print mode, and wherein the second offset pertains to a second print mode, e.g., normal print mode. In accordance with the present embodiment, both of the first offset and the second offset are determined based on the second sub-pattern, e.g., BIDI alignment sub-pattern 116.

In describing the present embodiment, it should be considered that controller 25 is configured to execute instructions to perform each operation of each embodiment disclosed below herein unless otherwise specified, such as, for example, the placing of print media sheet 30 on scan-bed 82, which is performed by the user, e.g., operator of imaging apparatus 14.

Figure 7A:
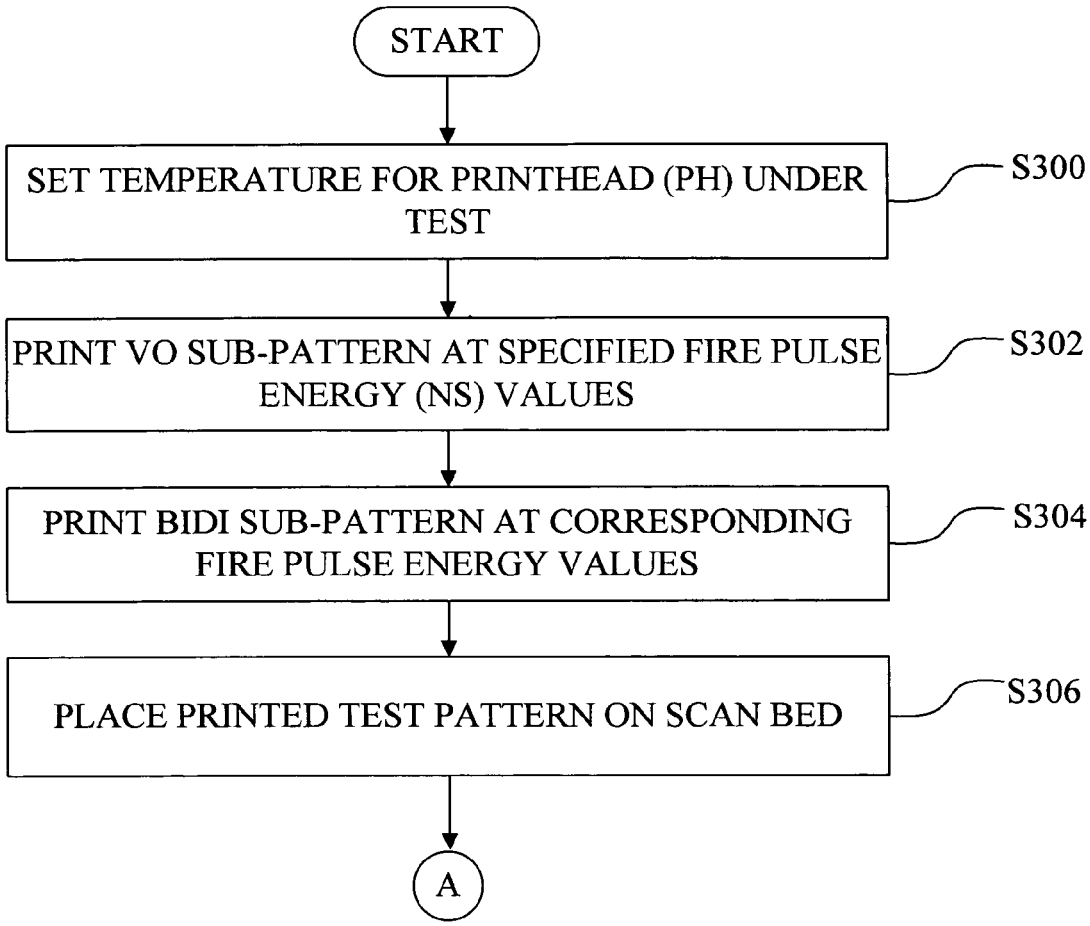
FIGS. 7A-7C are a flowchart depicting another embodiment of a method of calibrating a printhead in accordance with the present invention.

Referring now to FIG. 7A, at step S300, printhead 34 is stabilized at a desired operating temperature, e.g., 55° C.

At step S302, a VO sub-pattern 114 is printed at specified fire pulse energies, for example, firing pulses having pulse widths ranging from 950 nanoseconds to 500 nanoseconds. In the present embodiment, the VO sub-pattern consists of 6 rows of sets of two vertical bars, wherein the first row is printed at the maximum firing energy, e.g., 950 nanoseconds, and each following row, e.g., from top to bottom, is printed using a progressively lower firing energy, with the last row being printed at a firing energy of 500 nanoseconds. Thus, in the present embodiment, the first (top) row is printed at 950 nanoseconds, the second row at 860 nanoseconds, the third row at 770 nanoseconds, the fourth row at 680 nanoseconds, the fifth row 590 nanoseconds, and the sixth (bottom) row at 500 nanoseconds.

As with the previous embodiment, for each set of two adjacent vertical bars in VO sub-pattern 114, one bar is printed with printhead 34 traveling in left-to-right carrier scan direction 62, and the adjacent bar is printed in with printhead 34 traveling in right-to-left carrier scan direction 64. Thus, the bars are organized alternatingly such that for each side-by-side pair of bars in any given row, one bar is printed with printhead 34 traveling in left-to-right carrier scan direction 62, and the other bar is printed with printhead 34 traveling in right-to-left carrier scan direction 64.

VO sub-pattern 114 is printed in a draft quality print mode, e.g., 40 inches per second printhead carrier 32 scanning speed. Alternatively, however, VO sub-pattern 114 may be printed in normal print mode or any other desirable print mode without departing from the scope of the present invention.

As with the previous embodiment described above, in printing VO sub-pattern 114 with the present embodiment, the right-start adjust value is not employed, and thus the output of printhead 34 is considered to be raw.

Alternatively, however, it is contemplated that the right-start adjust value is employed, and ink drop velocity calculations are adjusted to compensate accordingly, as set forth below in step S312.

At step S304. BIDI alignment sub-pattern 116 is printed as six groups of 3 rows of vertical bars within each group. The top row of each group is printed using draft print mode (e.g., 40 ips) and all of the nozzles of printhead 34. The middle row of each group is printed in the normal print mode (e.g., 30 ips) using only the only the nozzles of printhead 34 that eject the big drop size, and not those nozzles that eject the small drop size. The bottom row of each group is printed in the normal print mode (e.g., 30 ips) using only the only the nozzles of printhead 34 that eject the small drop size, and not those nozzles that eject the big drop size.

A scanback graphic 118 is printed between VO sub-pattern 114 and BIDI alignment sub-pattern 116 to provide instructions to the user to place print media sheet 30 with test pattern 112 on scanner portion 19 of imaging apparatus 14 after the printing of test pattern 112 is completed.

As set forth above, the "normal" print mode is that print mode that provides the standard level of printing performance of imaging apparatus 14, as opposed to draft print mode, which produces printed output more quickly, but at a slight sacrifice of print quality. In the present embodiment, the normal print mode operates at a printhead carrier system 22 translational speed of 30 inches per second, whereas the speed for draft print mode is 40 inches per second.

For each set of two adjacent vertical bars in BIDI alignment sub-pattern 116, one bar is printed with printhead 34 traveling in left-to-right carrier scan direction 62, and the adjacent bar is printed in with printhead 34 traveling in right-to-left carrier scan direction 64. Thus, the bars are organized alternatingly such that for each side-by-side pair of bars in any given row, one bar is printed with printhead 34 traveling in left-to-right carrier scan direction 62, and the other bar is printed with printhead 34 traveling in right-to-left carrier scan direction 64.

As set forth above, BIDI alignment sub-pattern 116 is organized into six groups of three rows each. The firing energies for each group corresponds to the firing energies used to print the six rows of VO sub-pattern 114. For example, the first group of three rows is printed at a firing energy that corresponds to the firing energy used to print the top row of VO sub-pattern 114, e.g., 950 nanoseconds. Similarly, the firing energies used to print the second through sixth groups of BIDI alignment sub-pattern 116 correspond with the firing energies used to print the second through sixth rows of VO sub-pattern 114. Each of the three rows within a group are printed using similar firing energies.

At step S306, the user places print media sheet 30 containing the printed test pattern 112 on scan-bed 82 of scanner portion 19, and closes cover 84.

Figure 7B:
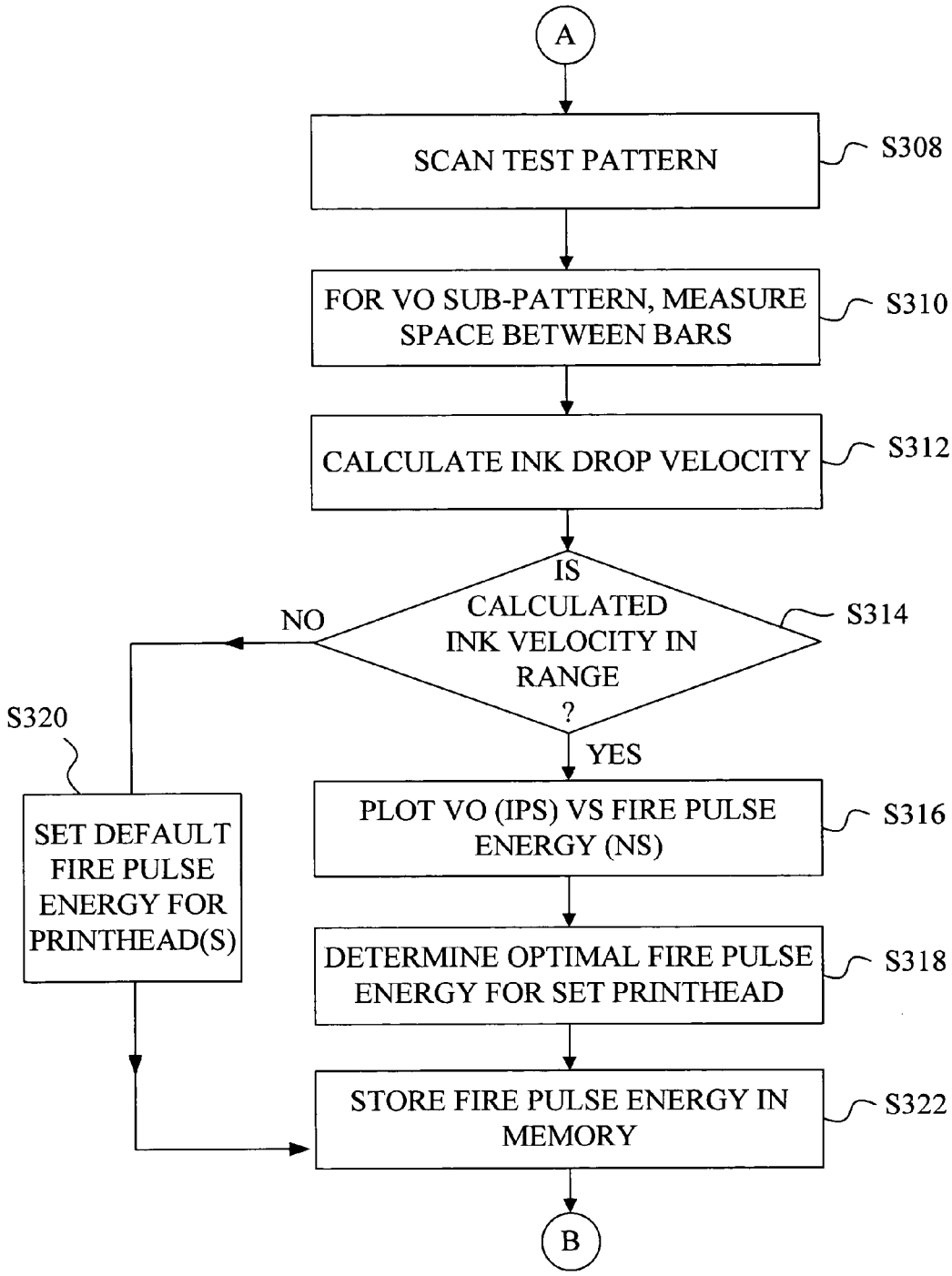

Referring now to FIG. 7B, controller 25 executes instructions to scan test pattern 112 to obtain calibration data and to perform and store in memory an ink drop velocity optimization for printhead 34 using the calibration data, as set forth in steps S308-S322. During the scanning of test pattern 112, printer portion 18, including printhead 34, may remain stationary, as they are independent of scanner portion 19.

At step S308, the entirety of test pattern 112 is scanned using scanner portion 19 of imaging apparatus 14 in a single scanning operation to obtain calibration data. The calibration data is based on measuring the distance between vertical bars of test pattern 112.

At step S310, the spaces between the vertical bars of VO sub-pattern 114 are measured as part of the calibration data obtained by the present invention, and are employed by the present invention in performing ink drop velocity optimization for printhead 34. The measurements of step S310 are similar to that described regarding the previous embodiment, as set forth above with respect to step S212 and FIG. 5. As set forth below in steps S324-S328, additional measurements are taken as part of the calibration data obtained by the present invention for use in determining bi-directional offset values that are used for performing bi-directional alignment of printhead 34.

At step S312, the ink drop velocity is calculated for each of the 6 rows of vertical bars of VO sub-pattern 114, for example, in the same manner as set forth above with respect to step S214. The ink drop velocity for each row is then stored in memory along with an identifier for the corresponding row.

At step S314, a determination is made as to whether the calculated ink drop velocities are within a predetermined range, for example, between 500 nanoseconds and 950 nanoseconds. If so, process flow proceeds to step S316. Otherwise, process flow proceeds to step S320, where a default fire pulse energy is set for printhead 34, e.g., 950 nanoseconds.

At step S316, the calculated ink drop velocities (VO), e.g., in units of inches per second (ips) are plotted against fire pulse energy, e.g., as measured in nanoseconds of pulse width, for example, as set forth above with respect to step S218 and with reference to FIG. 6.

At step S318, the optimal fire pulse energy for the set printhead, e.g., printhead 34, is determined, for example, as described above with respect to step S220.

At step S322, the fire pulse energy, which is the value determined at steps S314-S320, is stored in a memory of imaging apparatus 14, e.g., in controller 25, along with the corresponding row in VO sub-pattern 114, e.g., the first, second, third, fourth, fifth, or sixth row of VO sub-pattern 114. Alternatively, however, it is contemplated that the fire pulse energy and the corresponding row are stored in host 12 or as part of imaging driver 15.

Figure 7C:
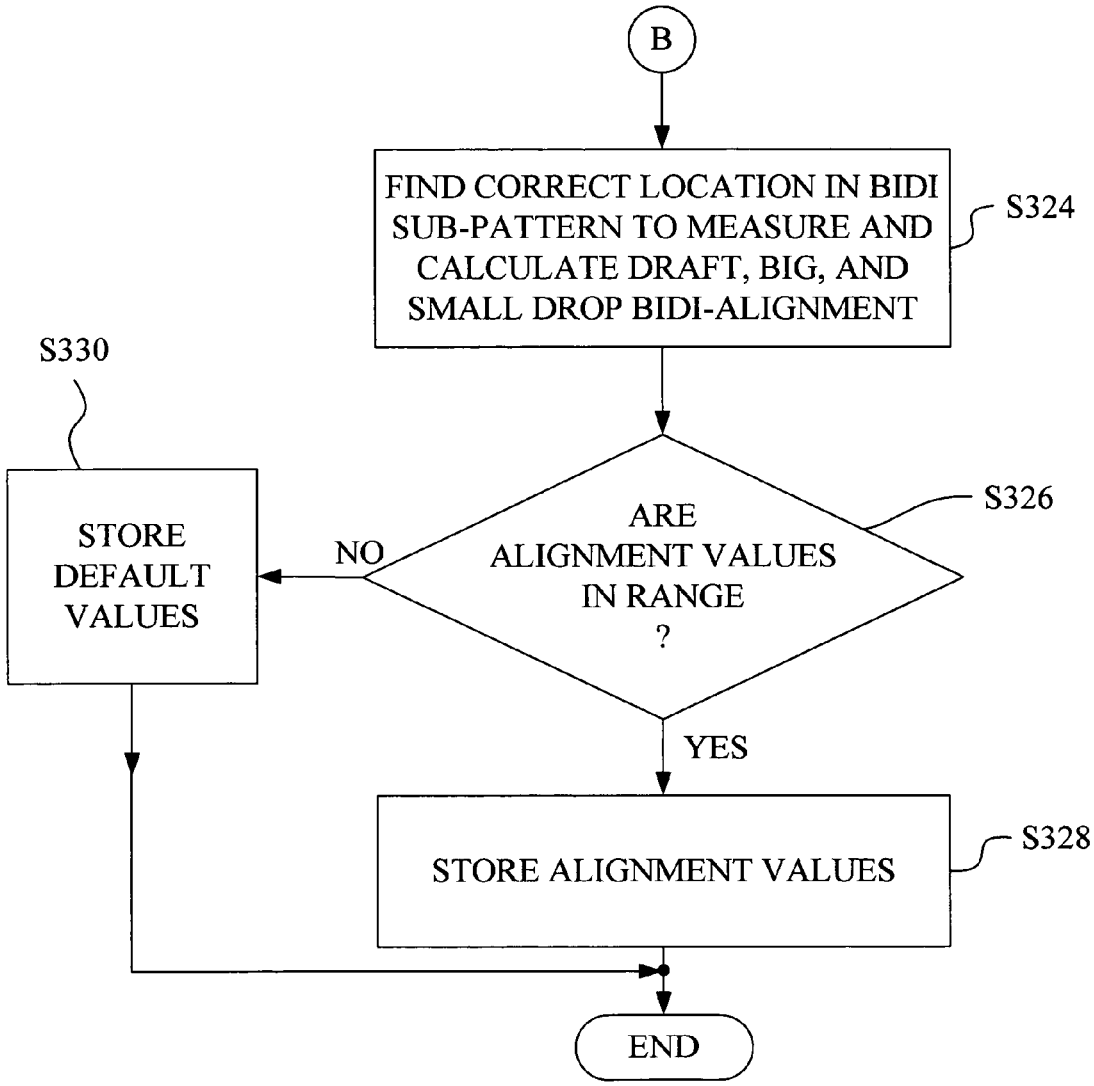
Figure 8:
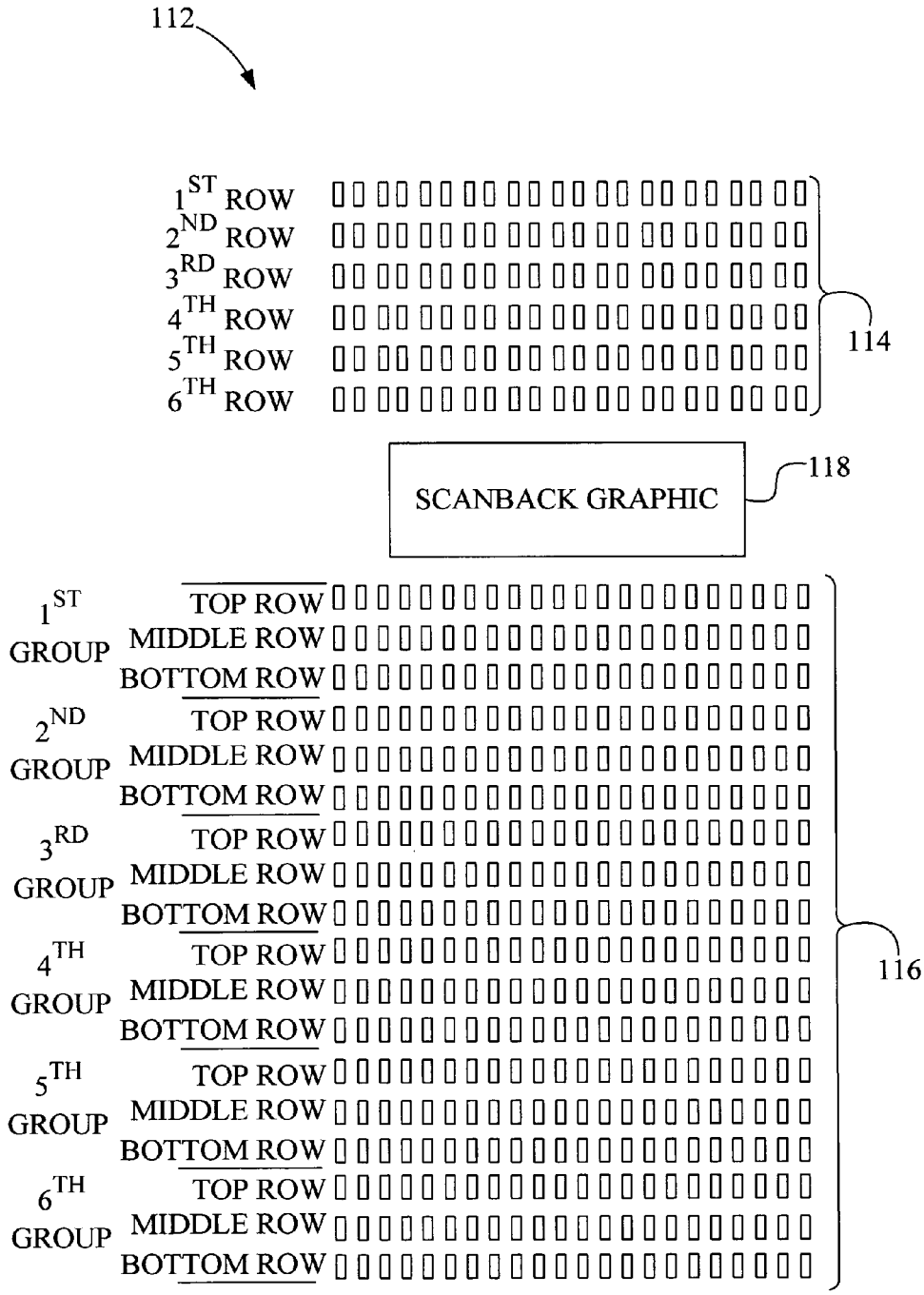
FIG. 8 depicts a test pattern that is printed and measured to determine ink drop velocity optimization and bi-directional offsets in accordance with another embodiment of the present invention.

Referring now to FIG. 7C, controller 25 executes instructions to scan test pattern 112 to determine bi-directional offsets based on the calibration data, as set forth in steps S324-S330, below.

At step S324, the correct group in BIDI alignment sub-pattern 116 is found and measured to calculate the draft print mode bi-directional offset and the normal print mode bi-directional offsets for both the printhead 34 nozzles that print the big drop size and the printhead 34 nozzles that print the small drop size, which yields three offset values, e.g., one each for draft print mode (one value for both drop sizes), for the big drop size in normal print mode, and for the small drop size in normal print mode.

For example, if the optimal ink drop velocity, and hence fire pulse energy, were found in steps S314-S322 to correspond with the second row in VO sub-pattern 114, the measurement data pertaining to the second group in BIDI alignment sub-pattern 116 will be used to calculate the draft print mode bi-directional offset. As with step S226, step S324 does not include a physical "finding" of the appropriate row in BIDI alignment sub-pattern 116, e.g., using scanner portion 19. Rather, step S324 pertains to electronically selecting the calibration data stored in memory that corresponds to the row associated with the fire pulse energy determined and stored in memory at steps S314-S320, e.g., the optimal or default fire pulse energy.

Once the appropriate group is found, the top row is measured to determine a bi-directional offset for the draft print mode (applicable for both big and small drop sizes), the middle row is measured to determine a bi-directional offset for the normal print mode for the nozzles of printhead 34 that eject the big drop size only, and the bottom row is measured to determine a bi-directional offset for the normal print mode for the nozzles of printhead 34 that eject the small drop size only.

The measurements used to determine the bi-directional offsets are similar to those described above with respect to the previous embodiment.

For example, referring again to FIG. 5, measurements of "A" and "B" are successively taken for all the bars the selected group in BIDI alignment sub-pattern 116, and, for each row are averaged to determine an average bi-directional offset between bars of D (AVG(A)−AVG(B))/2 for each of the draft print mode bi-directional offset and the normal print mode bi-directional offsets for the "big" drop size nozzles of printhead 34 and for the "small" drop nozzles of printhead 34.

Referring again to FIG. 7C, at step S326, it is determined whether the alignment values are within a predefined range, for example, between 0 and $^{80}/_{4800}$ inch. If so, process flow proceeds to step S328, and the bi-directional offsets for draft print mode (one offset value) and normal print mode (two offset values) are stored in a memory of imaging apparatus 14, e.g., in controller 25. Alternatively, however, it is contemplated that the bi-directional offsets are stored in host 12 or as part of imaging driver 15.

If at step S328 it is determined that the bi-directional alignment values are not within the predetermined range, process flow proceeds to step S330, wherein default values for each of the offset values that are not within the predetermined range are stored in memory in place of the corresponding values determined at step S326.

While this invention has been described with respect to exemplary embodiments, it will be recognized that the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for calibrating a printhead, comprising:
printing a test pattern;
scanning said test pattern to obtain calibration data;
performing an ink drop velocity optimization for said printhead using said calibration data; and
determining a bi-directional offset based on said calibration data.

2. The method of claim 1, wherein only a single printing operation is performed in order to completely print said test pattern.

3. The method of claim 1, wherein said test pattern includes a first sub-pattern and a second sub-pattern, and said bi-directional offset includes a first offset and a second offset, further comprising:
determining said ink drop velocity optimization based on said first sub-pattern; and
determining at least one of said first offset and said second offset based on said second sub-pattern.

4. The method of claim 3, further comprising determining at least one of said first offset and said second offset based on said first sub-pattern.

5. The method of claim 3, further comprising determining both of said first offset and said second offset based on said second sub-pattern.

6. The method of claim 3, wherein:
said first sub-pattern is printed using a first print mode;
said first offset pertains to said first print mode;
said second sub-pattern is printed using a second print mode; and
said second offset pertains to said second print mode.

7. The method of claim 6, wherein said first print mode is one of a normal print mode and a draft print mode, and said second print mode is the other of said normal print mode and said draft print mode.

8. The method of claim 3, wherein:
said second sub-pattern is printed using both a first print mode and a second print mode;
said first offset pertains to said first print mode; and
said second offset pertains to said second print mode.

9. The method of claim 8, wherein said first print mode is one of a normal print mode and a draft print mode, and said second print mode is the other of said normal print mode and said draft print mode.

10. A method for calibrating a printhead, comprising:
printing a single test pattern; and
scanning said single test pattern to determine an ink drop velocity optimization for said printhead and alignment data for said printhead.

11. The method of claim 10, wherein said alignment data includes a bi-directional offset for said printhead.

12. The method of claim 10, wherein said single test pattern is printed in a single printing operation on a print medium using an imaging apparatus without removing said print medium from a printer portion of said imaging apparatus prior to completion of printing of said single test pattern.

13. The method of claim 10, wherein said scanning said single test pattern is not performed until said single test pattern is completely printed.

14. The method of claim 10, wherein said scanning is performed as a single scanning operation of the entirety of said single test pattern.

15. An imaging apparatus configured for calibrating a printhead of said imaging apparatus, comprising:
a printer portion configured to mount said printhead;
a scanner portion; and
a controller communicatively coupled to said printer portion and said scanner portion, said controller being configured to execute instructions for:
printing a test pattern;
scanning said test pattern to obtain calibration data;
performing an ink drop velocity optimization for said printhead using said calibration data; and
determining a bi-directional offset based on said calibration data.

16. The imaging apparatus of claim 15, wherein only a single printing operation is performed in order to completely print said test pattern.

17. The imaging apparatus of claim 15, wherein said test pattern includes a first sub-pattern and a second sub-pattern, and said bi-directional offset includes a first offset and a second offset, further comprising said controller being configured to execute instructions for:

determining said ink drop velocity optimization based on said first sub-pattern; and determining at least one of said first offset and said second offset based on said second sub-pattern.

18. The imaging apparatus of claim 17, further comprising said controller being configured to execute instructions for determining at least one of said first offset and said second offset based on said first sub-pattern.

19. The imaging apparatus of claim 17, further comprising said controller being configured to execute instructions for determining both of said first offset and said second offset based on said second sub-pattern.

20. The imaging apparatus of claim 17, further comprising said controller being configured to execute instructions for:

printing said first sub-pattern using a first print mode, wherein said first offset pertains to said first print mode; and printing second sub-pattern using a second print mode, wherein said second offset pertains to said second print mode.

21. The imaging apparatus of claim 20, wherein said first print mode is one of a normal print mode and a draft print mode, and said second print mode is the other of said normal print mode and said draft print mode.

22. The imaging apparatus of claim 17, further comprising said controller being configured to execute instructions for:

printing said second sub-pattern using both a first print mode and a second print mode, wherein said first offset pertains to said first print mode; and said second offset pertains to said second print mode.

23. The imaging apparatus of claim 22, wherein said first print mode is one of a normal print mode and a draft print mode, and said second print mode is the other of said normal print mode and said draft print mode.

24. The imaging apparatus of claim 15, wherein said scanner portion is a flat bed scanner.

25. The imaging apparatus of claim 15, wherein said scanner portion and said printer portion are each configured for operation independent of the other such that said scanner portion performs said scanning while said printhead remains stationary in said printer portion.

* * * * *